US005353562A

United States Patent [19]

Decker

[11] Patent Number: 5,353,562

[45] Date of Patent: Oct. 11, 1994

[54] FOAM PANEL FOR CONSTRUCTION

[76] Inventor: Wendell T. Decker, 5719 E. Linden St., Tucson, Ariz. 85712

[21] Appl. No.: 179,511

[22] Filed: Jan. 10, 1994

Related U.S. Application Data

[63] Continuation-in-part of Ser. No. 2,644, Jan. 11, 1993, abandoned, which is a continuation of Ser. No. 725,575, Jul. 3, 1991, abandoned.

[51] Int. Cl.[5] ..... E04C 1/00

[52] U.S. Cl. ..... 52/309.7; 52/586.2; 52/281; 52/293.1; 52/271; 256/31

[58] Field of Search ..... 52/586.1, 586.2, 281, 52/241, 782, 309.7 OR, 309.4, 309.9, 309.12, 309.16, 628, 293.1, 266, 270, 271, 286; 256/31, 24, 73

[56] References Cited

U.S. PATENT DOCUMENTS

| | | | |
|---|---|---|---|
| 4,416,097 | 11/1983 | Weir | 52/293.1 |
| 4,567,699 | 2/1986 | McClellan | 52/127.7 |
| 4,599,841 | 7/1986 | Haid | 52/586.2 |
| 4,716,692 | 1/1988 | Harper et al. | 52/36 |
| 4,730,428 | 3/1988 | Head et al. | 52/586.2 |
| 4,774,794 | 10/1988 | Grieb | 52/309.7 |
| 5,097,643 | 3/1992 | Wittler | 52/281 |
| 5,129,628 | 7/1992 | Vesper | 256/31 |
| 5,247,773 | 9/1993 | Weir | 52/309.9 |
| 5,261,205 | 11/1993 | Sandor | 52/271 |

*Primary Examiner*—Carl D. Friedman
*Assistant Examiner*—Wynn E. Wood
*Attorney, Agent, or Firm*—Ogram & Teplitz

[57] ABSTRACT

A foam panel which is combined with a steel skeleton. Individual panels are connected to each other through the use of a key constructed of plastic, steel, aluminum, or the like. The key slips into a narrow groove on the panel to maintain the panels in proper alignment. The key is secured to a post located at the end of the panel. This post, constructed of such materials as strengthened plastic, steel, or heavy duty aluminum, is the bearing support for the panel assembly and is secured to the foundation or the flooring. Preferably, an assembly of many panels is manufactured in a "factory" setting and is transported to the construction site for easy installation.

21 Claims, 5 Drawing Sheets

FOAM PANEL FOR CONSTRUCTION

BACKGROUND OF THE INVENTION

This is a continuation-in-part of U.S. patent application Ser. No. 08/002,644, filed Jan. 11, 1993 now abandoned, and entitled "An Interlocking Foam Building Panel", which is a continuation of U.S. application Ser. No. 07/725,575, filed Jul. 3, 1991, and entitled "An Interlocking Foam Building Panel", now abandoned.

This invention relates generally to building materials and more particularly to the use of foam such as polystyrene as a component to building an edifice.

In the building trade, costs are paramount. Costs are usually divided into construction costs and operating costs. Construction costs include the materials, manpower and expertise, transportation, and other related expenses associated with the erection of the building. Operating costs relate to the expense in operating the building such as electricity needed for air conditioning.

A proper balance between these two costs creates the most economical building available.

Rigid plastic foam such as polystyrene have long been known to provide extremely high insulative powers and is lightweight in construction of building. Unfortunately, foam has little ability to withstand compression and as such is incapable of providing proper support for floors and roofs; this fact has limited its application in the building trade.

In an attempt to capitalize upon the insulative powers of polystyrene, a large number of arrangements have been developed which incorporate polystyrene foam into a traditional wall structure. These arrangements are exemplified by U.S. Pat. No. 4,875,322, entitled "Process for the Insulation of Existing Building Facades and Prefabricated Panel to be used in Applying said Process" issued Oct. 24, 1989, to Rozzi.

This type of arrangement does provide for added insulative powers, but, the costs are very high since the use of the polystyrene foam is merely an "add-on" and does nothing to assist in reducing the construction costs.

Eliminating the add-on characteristics is a group of devices which utilize the foam material to establish an exterior shell which accepts wet concrete which hardens to form a supporting core. An example of this type of device is described by U.S. Pat. No. 4,879,855, entitled "Attachment and Reinforcement Member for Molded Construction Forms" issued to Berrenberg on Nov. 14, 1989. When completed, this arrangement establishes interior concrete walls with foam panels forming the faces.

Several problems plague this approach. First, there is a significant chance that gaps or holes are formed when the concrete is poured; thereby reducing the structural integrity. Second, the costs associated with the construction can be very high due to the large volume of concrete which is required.

Because a large portion of buildings are made with concrete blocks, there has been a natural tendency to utilize polystyrene shaped as a block and then fill a void therein with concrete. An example of this approach is U.S. Pat. No. 4,986,049, entitled "Insulated Building Block" issued to Kennedy et al. on Jan. 22, 1991.

Although the shape is familiar, the resulting blocks are so lightweight that the true ability of the foam is not fully capitalized upon. Additionally, as with the forms discussed above, an inner core of concrete is used to provide structural integrity. Also as with the forms, there is a great chance that gaps or holes in the concrete are established during the pouring process which limit the integrity of the block.

In an effort to reduce the amount of labor required in the construction of buildings, a large number of approaches have been developed which attempt to create pre-made panels out of polystyrene foam. A typical example of this approach is U.S. Pat. No. 3,555,131, entitled "Method for Making Reinforced Modular Foam Panels" issued to Weismann on Jan. 12, 1971.

Although these approaches do reduce construction labor, the resulting panels are costly and are extremely fixed in design which limits the panel's versatility.

It is clear from the foregoing that an efficient use of foam in the construction industry does not exist.

SUMMARY OF THE INVENTION

In the preferred embodiment of the invention, a foam panel is combined with a steel skeleton. Individual panels are connected to each other through the use of a key constructed of plastic, steel, aluminum or the like. The key slips into a narrow groove on the panel to maintain the panels in proper alignment. The key is secured to a post located at the end of the panel. This post, constructed of such materials as strengthened plastic, steel, or heavy duty aluminum, is the bearing support for the panel assembly and is secured to the foundation of the flooring. Preferably, an assembly of many panels is manufactured in a "factory" setting and is transported to the construction site for easy installation.

In an alternative embodiment of the invention concrete is used instead of the above skeleton of plastic or metal. This embodiment is most suitable for on-site construction as the concrete skeleton is more susceptible to breaking than the steel skeleton of the preferred embodiment.

The invention of the alternative embodiment is an interlocking foam building panel which has troughs formed in the upper surface and both ends. The end troughs mate with the end troughs of other panels and form a tube which accepts wet concrete. A reinforcing bar extends upward from the foundation through the so formed tube. Similarly, a reinforcing bar is placed in the upper trough and wet concrete fills the trough before the next layer of panels is placed onto the prior layer. In this manner, the foam acts as insulating material, structural walls, and as a form for the concrete frame.

The present discussion refers to polystyrene foam, but those of ordinary skill in the art readily recognize that the present invention is not to be so limited. Any rigid plastic member is applicable to this invention.

The basic component to the present invention is a panel formed entirely from polystyrene foam. In the preferred embodiment, the panel is two feet by eight feet by eight inches and is substantially rectangular. Other overall sizes and shapes are obvious to those of ordinary skill in the art.

Along the top and down both ends is dug a trough. In the preferred embodiment, this trough is approximately six inches deep and six inches wide.

In an alternative embodiment of the invention, only one end has a trough formed therein. This embodiment reduces the time for manufacturing and costs in manufacturing while maintaining the integrity of the inventive concept. In this embodiment, the end without a trough has spikes pressed into it to assist in the bonding with the wet cement held by the next panel's side trough.

During construction, a row of panels is placed on the footing for the building and is secured from shifting through the use of spikes extending from the footing. Also extending from the footing are vertical reinforcing bars (commonly called "rebar") which extend upward at each corner and every eight feet through the tubes formed by the abutment of the two panels.

The panels are arranged such that the vertical rebars are encircled by the troughs at the end of the panels. Through the use of hangers or clips, other reinforcing bars are suspended in the troughs at the top of the panels.

Once a row of polystyrene foam panels is installed, wet cement is applied to fill the troughs along the top as well as downward through the columns to the footing. This forms a wall which has polystyrene foam providing not only a good part of the wall, but also is a form for the concrete skeleton which is being created, row by row.

The second row of panels is applied in a similar manner to the first with the second row secured to the first through spikes which are placed in, and extend from, the wet cement in the top trough.

In an alternative embodiment, the spike is part of the hanging mechanism for the reinforcing bar. In still another embodiment, the panels are equipped with a tongue and groove arrangement which permits the panels to lock into each other and form secure seals therebetween.

Once the walls have been constructed, the resulting arrangement utilizes the foam for the vast majority of wall space and requires only a limited amount of concrete.

Note that the application of the concrete does not require any great skill or training. The columns are merely filled and the top trough is filled and troweled level. No leveling or complex setting is required.

The vertical concrete columns so formed provide support for the roof or for the second floor. The vertical concrete columns provide excellent structural integrity.

Once the foam/concrete wall have been established, the placement of wires and pipes through the house is easily facilitated through the use of a router which creates a groove in the polystyrene foam.

The inside of the wall is finished through a variety of techniques known to those of ordinary skill in the art such as simply gluing sheetrock onto the foam.

The exterior of the building is finished through the use of plastering. Adhesion of the plaster is facilitated through the use of wire which attaches to an extension from the horizontal concrete skeleton.

In the preferred embodiment of the invention, the foam panel is combined with a skeleton. Individual panels are connected to each other through the use of a metal key constructed of plastic, steel, aluminum, or the like. The key slips into a narrow groove on the panel to maintain the panels in proper alignment.

Various configurations for the key exist. One shape is a "t" which has four extensions. Two opposing extensions are used to lock two panels to each other. The remaining extensions keep the key from bending during pressure or load bearing.

The key is secured to a post located at the end of the panel. This post, constructed of such materials as strengthened plastic, steel, or heavy duty aluminum, is the bearing support for the panel assembly and is secured, ultimately, to the foundation of the flooring.

Preferably, an assembly of many panels is manufactured in a "factory" setting and is transported to the construction site for easy installation. Because the bulk of the wall unit constructed of these panels and skeleton is composed of foam, the overall wall unit is extremely light and is easily moved to the construction site.

Additionally, the wall unit, being constructed in a factory setting, permits both the interior paneling or covering to be put on the unit as well as the exterior coating. In this context, the preferred exterior coating is composed of a plaster-like material commercially known as "Dryvit" and is available from Dryvit Systems, Inc. The coating is an acrylic-formulated coat which adheres to a webbing placed over the surface of the foam panels.

The invention together with various embodiments thereof will be more fully described by the following drawings and their accompanying descriptions.

DRAWINGS IN BRIEF

DRAWINGS IN DETAIL

Figure 1:
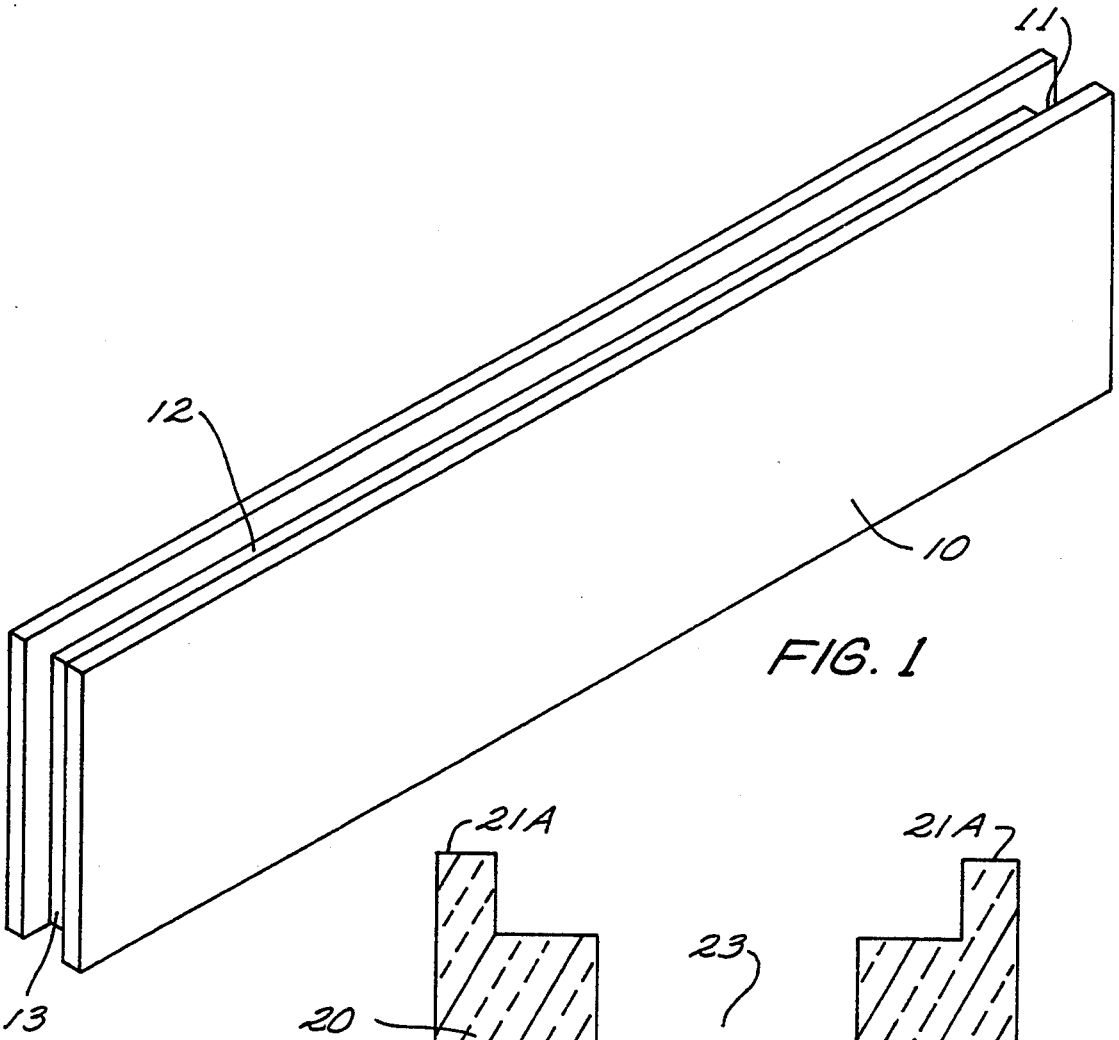
FIG. 1 is perspective view of an embodiment of the panel.

FIG. 1 is a perspective view of an embodiment of the panel.

Panel 10 is a substantially rectangular piece of solid polystyrene foam. Along the top portion of the panel, trough 12 is created; similarly, along both ends, trough 13 and 11 are also established.

These troughs create forms for holding the wet concrete and after the drying of the concrete, provide the securing of the foam panel to the hardened concrete skeleton.

In this embodiment of the invention, panel 12 is approximately two feet by eight feet by eight inches. All the troughs are centered and are approximately six inches wide and six inches deep.

Those of ordinary skill in the art readily recognize various mechanisms which may be employed to create these troughs such as router or saw.

Figure 2A:
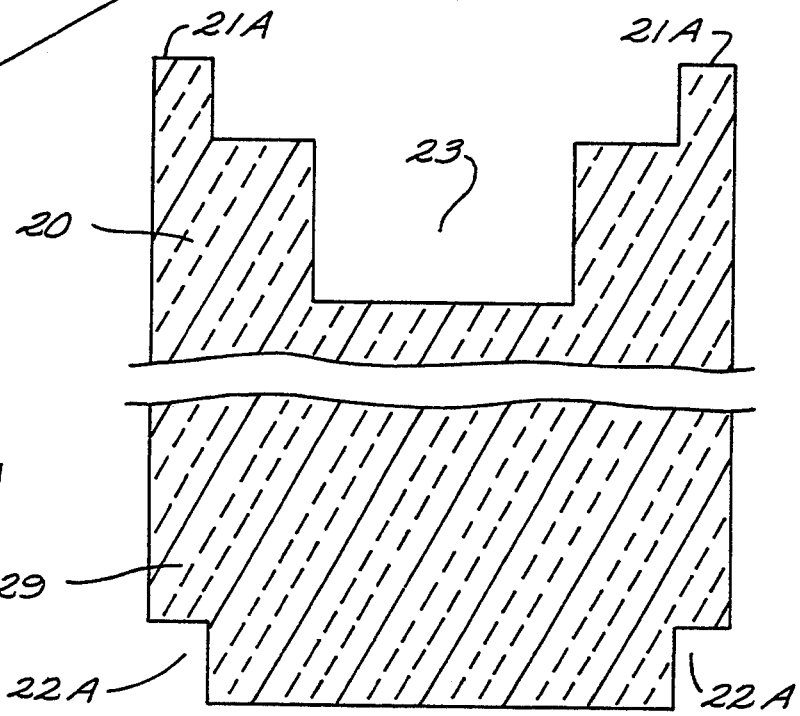
FIGS. 2A and 2B are cutaway views of two embodiments in which a tongue and groove arrangement is utilized.
Figure 2B:
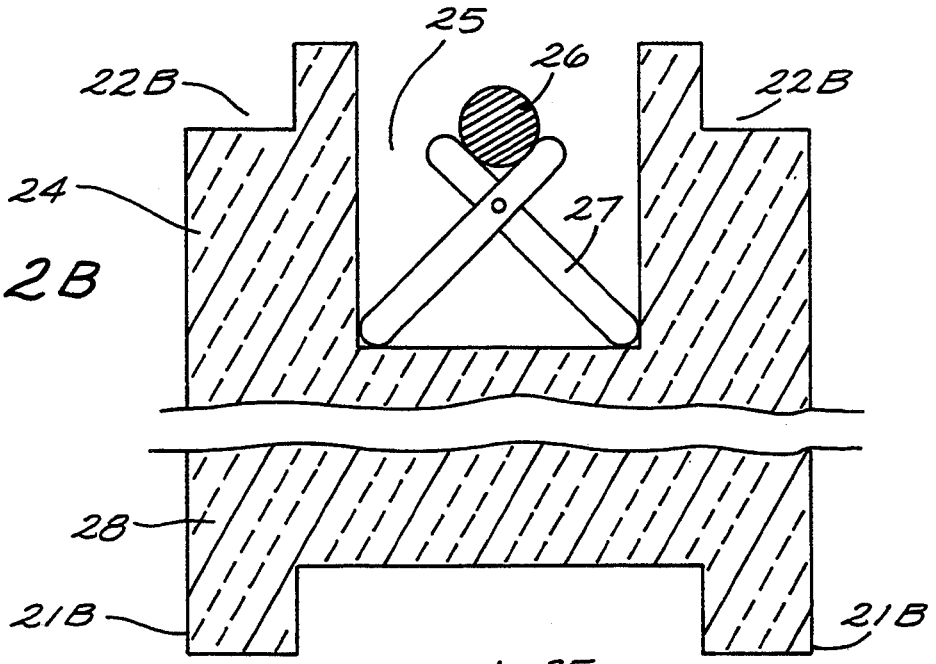

FIGS. 2A and 2B are cutaway views of two embodiments in which a tongue and groove arrangement is utilized for sealing and binding adjoining panels to each other.

Referring to FIG. 2A, top portion 20 and bottom portion 29 are from the same panel. Top portion 20 has trough 23 formed therein which is shaped to include tongue members 21A. When a mating panel is placed onto the top portion 20, its grooves 22A mate with tongue members 21A forming an airtight fit.

FIG. 2B utilizes the tongue and groove arrangement in a similar manner. In this embodiment, trough 25 has grooves 22B associated therewith so that when a bottom portion 28 fits into top portion 24 of another panel, tongue members 21B fit and form the airtight fit.

In the embodiment of FIG. 2B, reinforcing bar 26 is suspended in trough 25 via the use of cradle 27. Cradle 27 permits the wet concrete to flow completely around reinforcing bar 26 and thereby provide tremendous structural support and integrity.

Figure 3A:
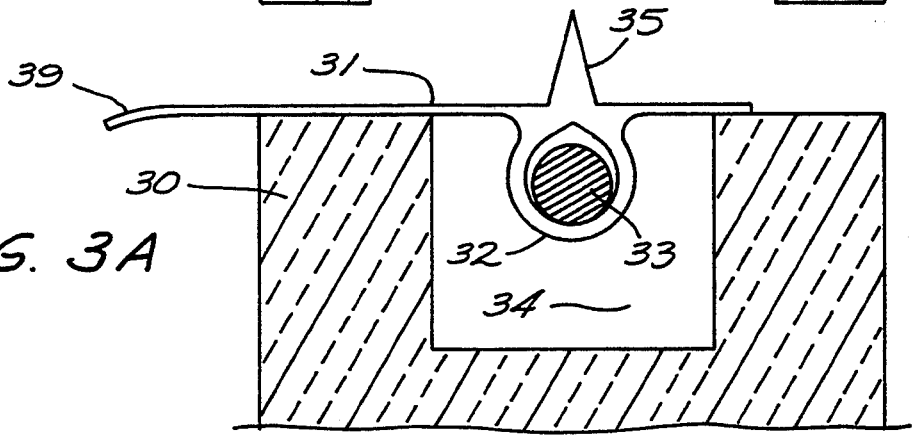
FIGS. 3A and 3B are cutaway views of two embodiments for supporting the reinforcing bar in the top trough.
Figure 3B:
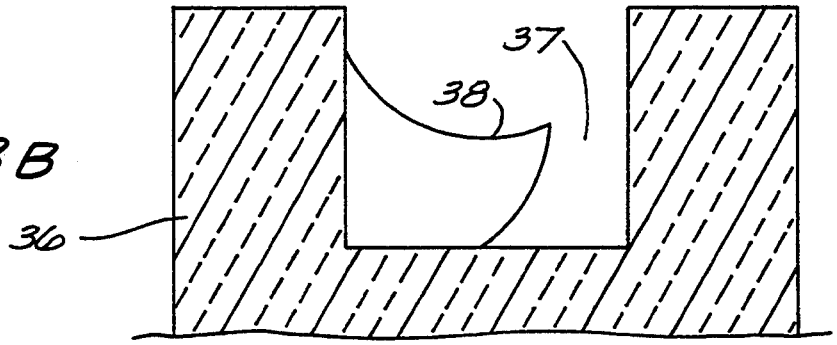

FIGS. 3A and 3B are cutaway view of two embodiments for supporting the reinforcing bar in the trough at the top of the panel.

Suspending or supporting the reinforcing bar within the trough is accomplished by many mechanisms. As illustrated in FIG. 3A, cradle 31 extends over trough 34 and has loop 32 for supporting reinforcing bar 33 therein. Cradle 31 also includes spike 35 which is used to impale and secure the next polystyrene panel to panel 30.

Extension 39 extends past a face of panel 30 and provides a tying member for plaster wire or the like.

This arrangement permits the easy application of a suspension of reinforcing bar 33 while preparing the panel for subsequent panels and eventual plastering.

FIG. 3B illustrates the use of the foam itself to suspend the reinforcing bar. During the routing of trough 37 of panel 36, periodically a support member 38 is created to accept and hold a reinforcing bar (not shown).

This embodiment of the invention eliminates any extra hangers and thereby reduces installation time and complexity.

Figure 4:
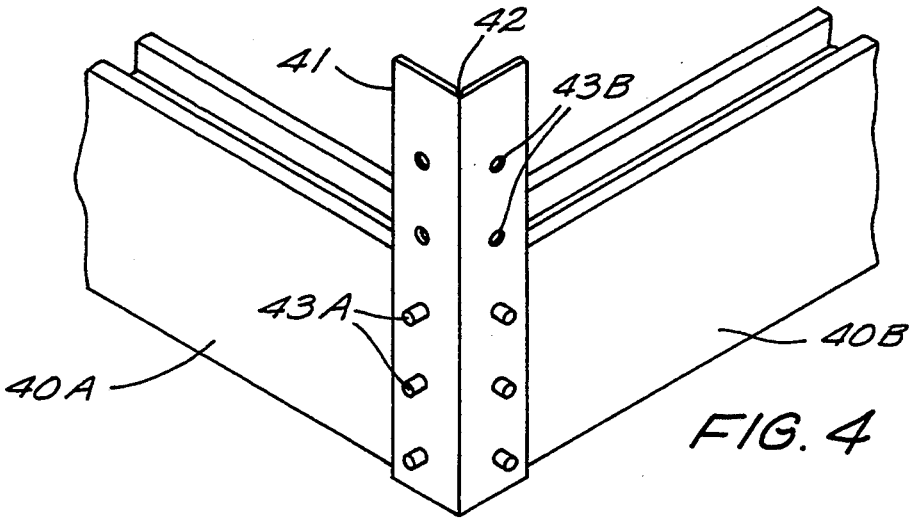
FIG. 4 is a perspective view of an apparatus used for framing the corner columns.

FIG. 4 is a perspective view of an apparatus used for framing the corner columns.

Although the end troughs of the present invention provide forms for the pouring of wet concrete when the panels are end to end, at corners and such, added forming is preferred. Those of ordinary skill in the art readily recognize that by removing one wall of the trough, two panels may be butted together at a ninety degree angle to form a suitable trough.

The device illustrated in FIG. 4 permits the creation of an enhanced concrete column. Panels 40A and 40B meet to form a corner. Apparatus 41 extends around, and completes, this corner. Apparatus 41 ties to the polystyrene panels 40A and 40B via fasteners 43A extending through holes such as 43B.

When the concrete has properly set, fasteners 43A are removed and apparatus 41, via hinge 42, folds back and away so as to be stripped away and used elsewhere.

In this manner, and enhanced corner concrete column is created which permits support of the roof, balcony, or second floor.

Figure 5:
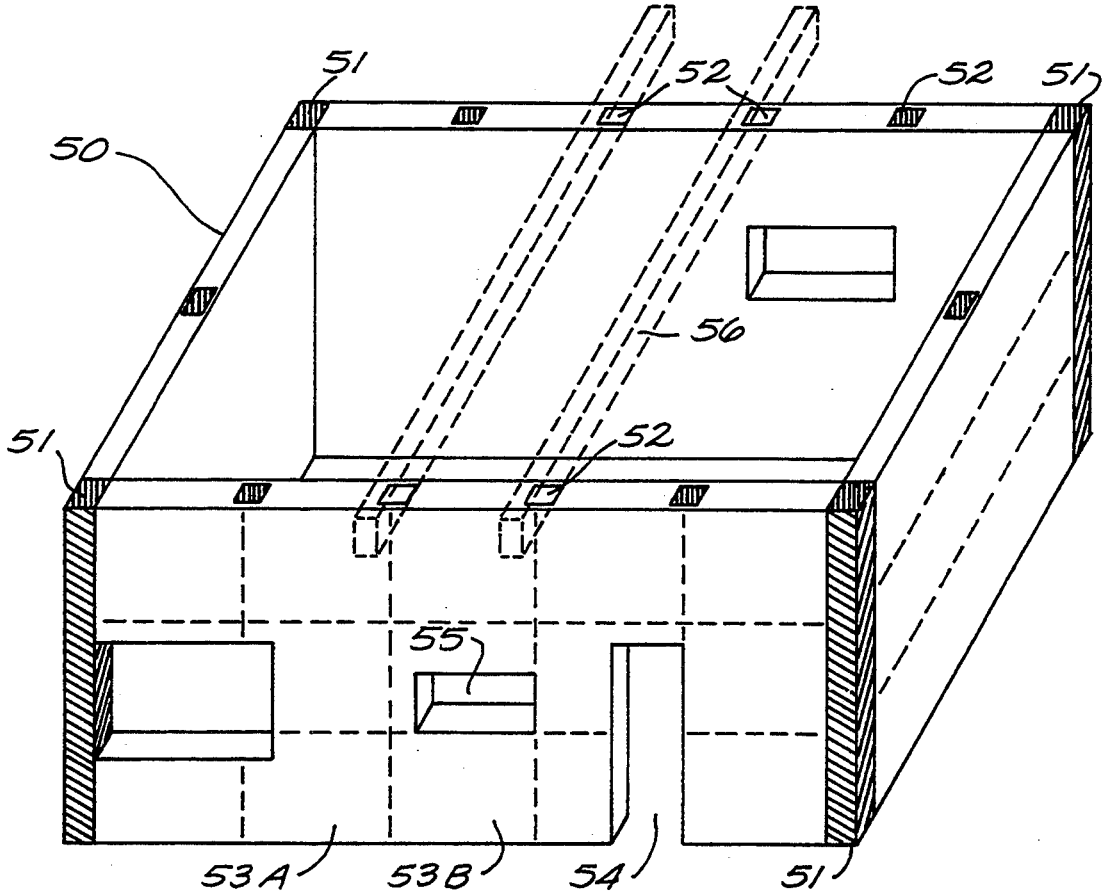
FIG. 5 is a perspective view of the walls of a house constructed in accordance with the present invention.

FIG. 5 is a perspective view of the walls of a house constructed in accordance with the present invention.

Building 50 has as its basic constructional component, panels as described before and shown as 53A and 53B. Fitting together, these panels permit the creation of concrete columns 52 and concrete corners 51 for support of roof members 56. Door 54 and window 55 are established during construction merely by cutting the polystyrene foam to obtain the desire shape.

In this manner, a building is created which has improved thermal properties but also is quick and inexpensive to build due to reduction in labor, materials, and expertise in creation.

Figure 6A:
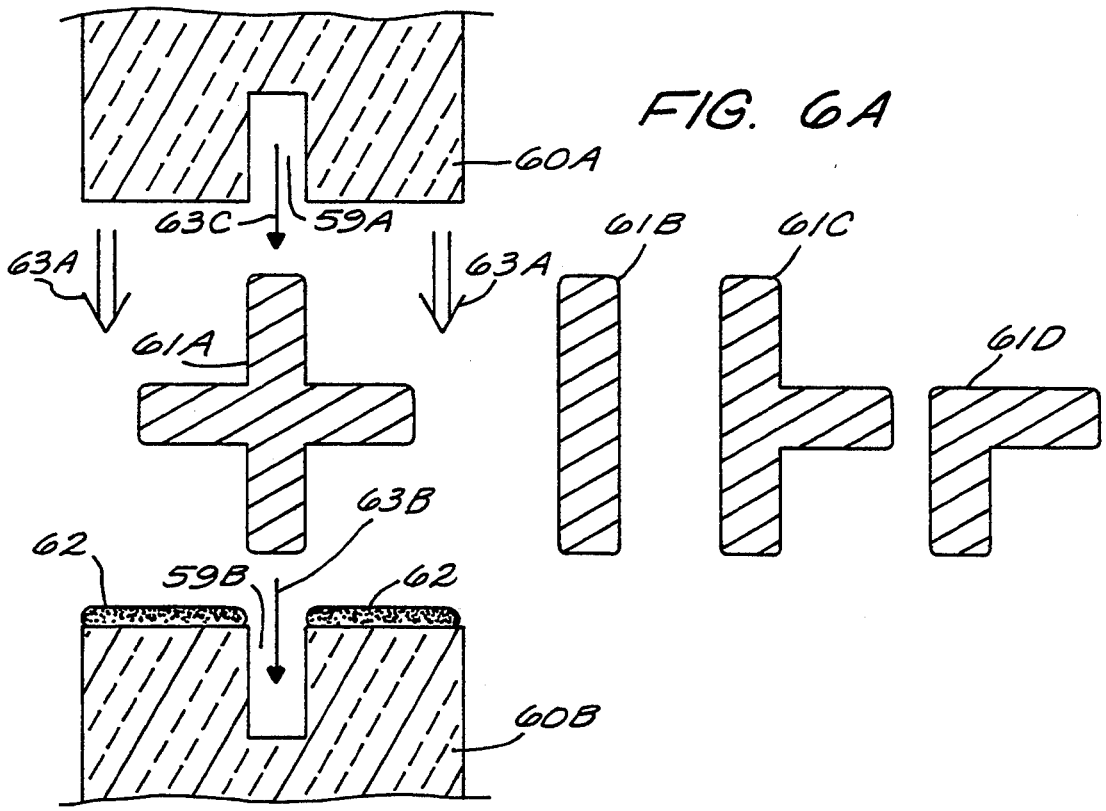
FIG. 6A is a side view illustrating the key construction.

FIG. 6A is a side view illustrating the key construction. Foam panel 60A is a polystyrene block preferably having the dimensions of four feet by eight feet by four inches. Those of ordinary skill in the art recognize that any dimension is available; to obtain the desired results though the invention contemplates that the panel will be within the following ranges:

Length-4–9 feet
Height-2–5 feet
Width-3–12 inches.

Along the bottom face of foam panel 60A is a groove or notch 59A; along the top face, as illustrated in panel 60B, is another groove 59B. These grooves are preferably narrow on the order of only a half inch to one inch, or less.

Key 61A is dimensioned to fit into grooves 59A and 59B to lock panels 60A and 60B to each other. Key 61A is "t" shaped which provides excellent mechanical rigidity to prevent "buckling" or bending of the foam panels once full assembly has been accomplished.

In certain applications, other shapes are more suitable for the key. Key 61B is a simple flat stock which is easily inserted into grooves 59A and 59B. In similar fashion, key 61C obtains some of the rigidity associated with Key 61A while reducing the overall weight.

Key 61D is an angle piece which maintains rigidity. Key 61D is used as a pair in which one angle engages the lower panel while the second key 61D engages the overlying panel. See FIG. 6D for a more full explanation of the workings of this embodiment.

Adhesive 62 is placed along one of the panel's face, panel 60B in this illustration, and the entire assembly of panel 60A, key 61A, and panel 60B are forced together as illustrated by arrows 63A, 63B, and 63C. This connects a bottom panel to an overlying panel.

Figure 6B:
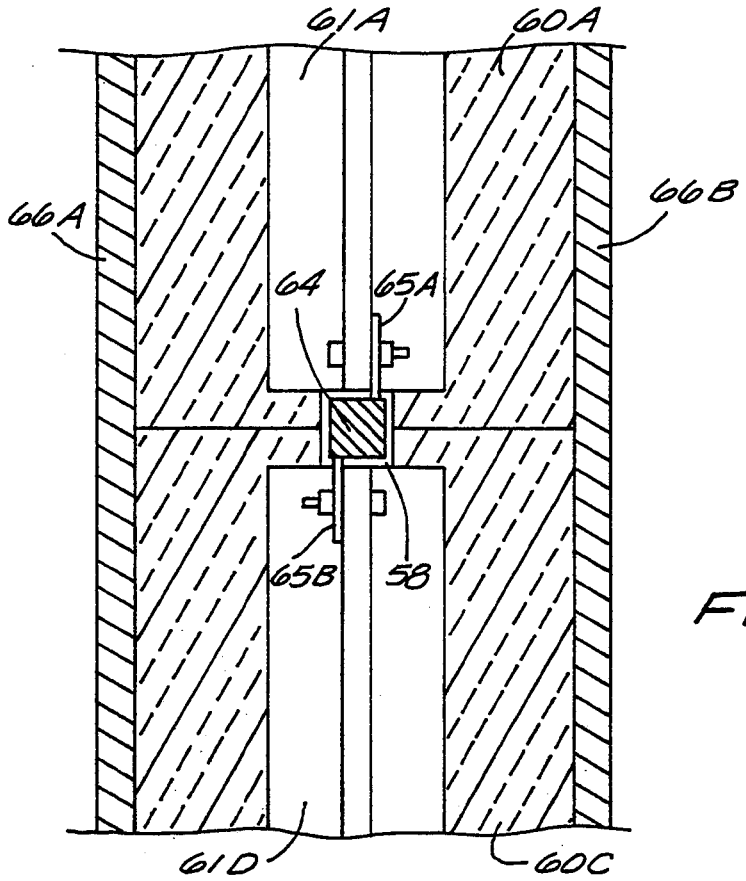
FIG. 6B is a top view of the key construction.

FIG. 6B is a top view of the key construction. Along the edges of the foam panels 60A and 60C, a channel or groove 58 is constructed to accept post 64. Foam panel 60A has associated with it key 61A; foam panel 60C has associated with it key 61D. These keys are attached to post 60 via wings 65A and 65B respectively. By bolting the wings to the keys, a firm and rigid skeleton inside the foam panels is constructed.

Adhesive, not shown in this illustration, is also used to secure panel 60A to panel 60C.

A facing material, such as that described relative to "Dryvit" is used to create a facing 66A for the "exterior" portion of the of assembly. Another facing material, chosen from those well known in the art, is applied to the "interior" of the assembly to create a completed wall unit. The interior facing material can be any of a variety of materials including wood paneling which is glued to the foam panels, fiber board adhered to the panels, and the like.

Figure 6C:
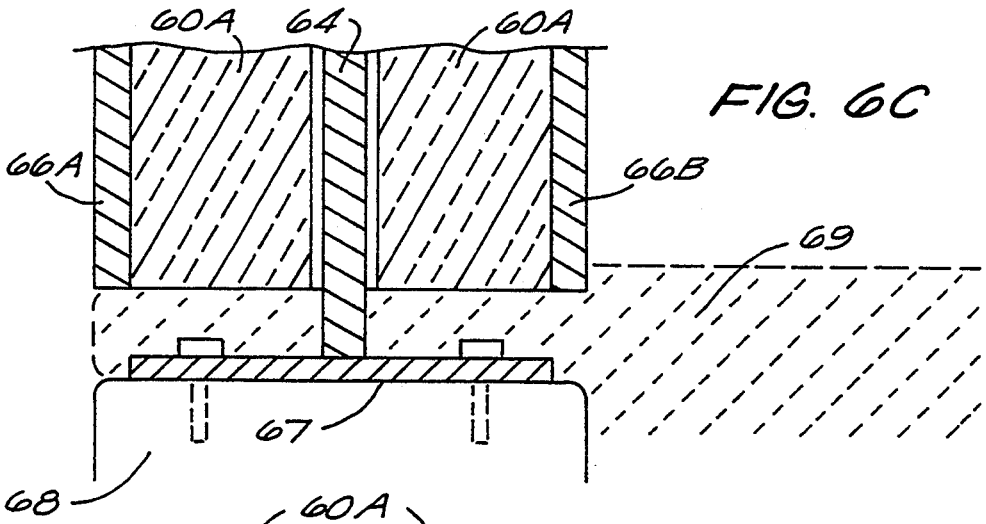
FIG. 6C is a side view of the key construction illustrating the post's attachment to the footing.

FIG. 6C is a side view of the key construction illustrating the post's attachment to the footing. At the base of post 64, is base plate 67 which is used to secure the post, and hence the foam panel 60A, to foundation 68. Bolts are used in this embodiment.

Once the panel is installed, flooring cement 69 is poured and provides for exceptional weatherproofing of the building.

An important aspect which is readily seen is that the entire operation as described in FIGS. 6A, 6B, and 6C for the construction of the wall units can be done either at the construction site, or more preferably, at a factory where economy of scale is used to keep costs to a minimum.

Figure 6D:
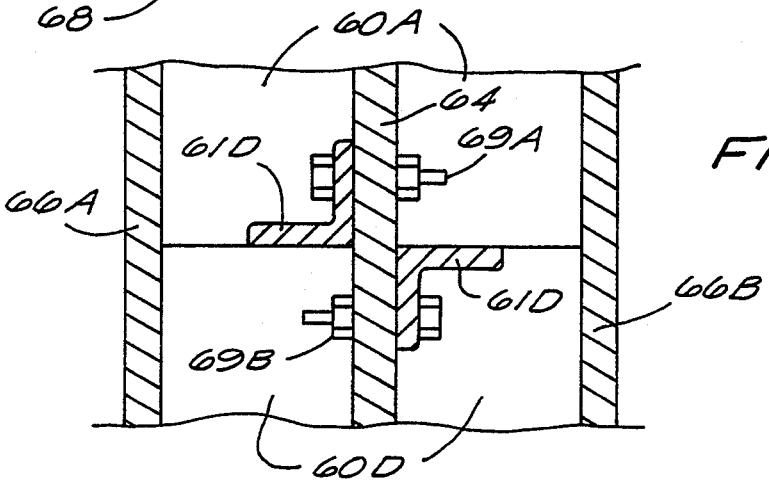
FIG. 6D is a side view showing the dual key construction in which the keys are angle pieces.

FIG. 6D is a side view showing the dual key construction in which the keys are angle pieces 61D.

Foam panel 60A is to be placed over foam panel 60D to form a wall. A key 61D is used to engage foam panel 60A while another key 61D is used to engage foam panel 60D. Each of these keys 61D are then attached to post 64 via bolt arrangments 69A and 69B respectively.

This arrangement provides for an extremely rigid and durable panel since the various components are bolted to each other via the post which provides for the load bearing member. The panels so constructed, are easily transported to the construction site for final assembly into the building.

Figure 7:
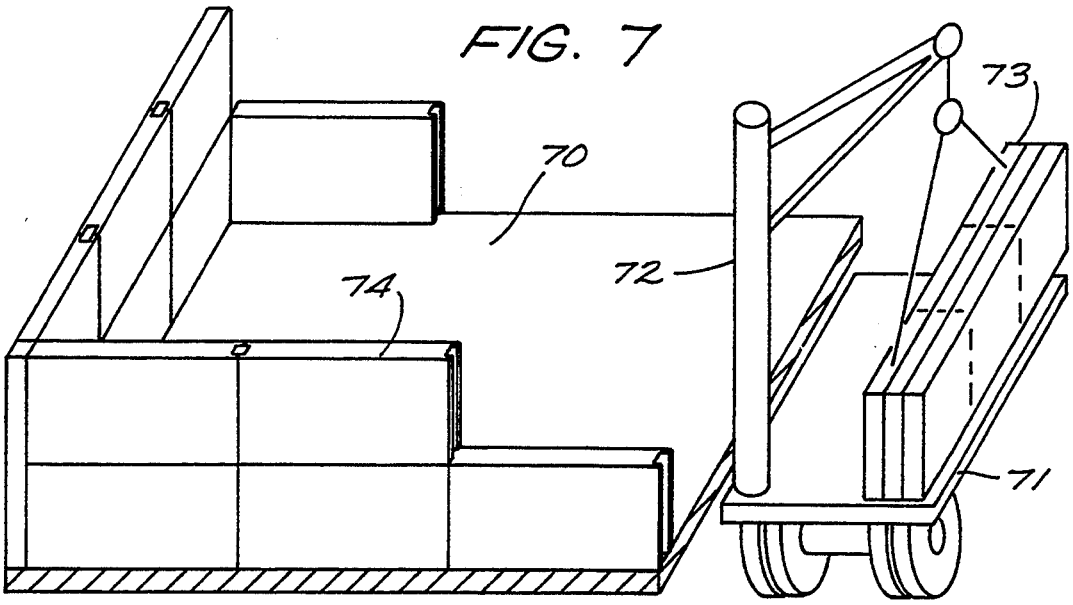
FIG. 7 is a perspective view showing the installation of assemblies of foam panels with the skeleton.

FIG. 7 is a perspective view showing the installation of assemblies foam panels with skeleton.

Truck 71 is used to transport the wall units 73 to the construction site. Each wall unit is constructed of a plurality of foam panels already assembled with their skeleton. In the preferred embodiment, each foam panel is four feet by eight feet and a wall unit consists of a 2×4 array of panels resulting in a wall unit having a general overall dimension of eight feet by thirty-two feet.

Using crane 72, the wall units are removed from the trailer 71 and deposited on the foundation 70 where they are to be secured, as shown by 74. In this manner, the units are pieced together to construct a warehouse of about ninety-six feet square with a sixteen foot ceiling.

Construction at the site is reduced to a minimum since the wall units come to the site ready for installation.

It is clear from the foregoing that the present invention creates a foam panel and resulting wall which is vastly superior to that which is currently available.

What is claimed is:

1. A construction assembly comprising:

a) a plurality of foam panels, each of said foam panels having a top groove being less than half an inch in width and extending along a top face of said foam panel, a bottom groove being less than half an inch in width and extending along a bottom face of said foam panel, and a side groove extending along a side face of said foam panel, each of said foam panels being at least two feet high, at least seven feet long, and three to eight inches wide;

b) a key member matably engaged with the top groove of a first foam panel and the bottom groove of a second foam panel; and, c) a post member positioned in said side groove and attached to said key member.

2. The construction assembly according to claim 1 wherein said post is attached to said key member by a bolt and nut combination.

3. The construction assembly according to claim 1 further including an adhesive positioned to engage both said first foam panel and said second foam panel.

4. The construction assembly according to claim 3 further including a facing material attached to a face formed by said first foam panel and said second foam panel.

5. The construction assembly according to claim 4 wherein said key member is "t" shaped.

6. The construction assembly according to claim 5 wherein said key member is metallic.

7. The construction assembly according to claim 4 wherein said post member includes a foot assembly for securing said post to a foundation.

8. A construction assembly comprising:

a) at least two foam panels, each of said foam panels having a top groove extending along a top face of said foam panel, a bottom groove extending along a bottom face of said foam panel, and a side groove extending along a side face of said panel;

b) a key member matably engaged with the top groove of a first foam panel and the bottom groove of a second foam panel; and, c) a post member positioned in said side groove of said panel, said post member attached to said key member.

9. The construction assembly according to claim 8 wherein said post is attached to said key member by a bolt and nut combination.

10. The construction assembly according to claim 8 further including an adhesive positioned to engage both said first foam panel and said second foam panel.

11. The construction assembly according to claim 10 further including a facing material attached to a face formed by said first foam panel and said second foam panel.

12. The construction assembly according to claim 11 wherein said key member is "t" shaped.

13. The construction assembly according to claim 12 wherein said key member is metallic.

14. The construction assembly according to claim 8 wherein said post member includes a foot assembly for securing said post to a foundation.

15. The construction assembly according to claim 8 wherein each of said panels are substantially four foot by eight foot and has a width of three to eight inches.

16. The construction assembly according to claim 15 wherein said top groove and said bottom groove are less than half an inch wide.

17. A prefabricated wall unit comprising:

a) a plurality of foam panels, each of said foam panels having a top groove extending along a top face of said panel, a bottom groove extending along a bottom face of said panel, and a side groove extending along a side face of said panel;

b) a plurality of key members, each of said key members matably engaged with the top groove of a first foam panel and the bottom groove of a second foam panel; and, c) a plurality of post members, each of said post members positioned in one of said side grooves and attached to at least one of said key members.

18. The prefabricated wall unit according to claim 17 further including an adhesive positioned to engage adjoining foam panels.

19. The prefabricated wall unit according to claim 18 further including a facing material attached to a face formed by said foam panels.

20. The prefabricated wall unit according to claim 19 wherein each of said post members includes a foot assembly for securing said post to a foundation.

21. The prefabricated wall unit according to claim 20 wherein said prefabricated wall unit is at least sixteen feet long and seven feet high and has a width of three to eight inches.

* * * * *